US009749767B2

(12) United States Patent
Kim

(10) Patent No.: US 9,749,767 B2
(45) **Date of Patent: *Aug. 29, 2017**

(54) METHOD AND APPARATUS FOR REPRODUCING STEREOPHONIC SOUND

(71) Applicant: SAMSUNG ELECTRONICS CO., LTD., Suwon-si (KR)

(72) Inventor: Sun-min Kim, Yongin-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 52 days.

This patent is subject to a terminal disclaimer.

(21) Appl. No.: 14/835,303

(22) Filed: Aug. 25, 2015

(65) Prior Publication Data

US 2015/0365777 A1 Dec. 17, 2015

Related U.S. Application Data

(63) Continuation of application No. 13/100,442, filed on May 4, 2011, now Pat. No. 9,148,740.

(60) Provisional application No. 61/330,986, filed on May 4, 2010.

(30) Foreign Application Priority Data

Mar. 14, 2011 (KR) ..... 10-2011-0022451

(51) Int. Cl.
*H04R 5/00* (2006.01)
*H04S 5/00* (2006.01)
*H04S 1/00* (2006.01)

(52) U.S. Cl.
CPC ..... *H04S 5/00* (2013.01); *H04S 1/002* (2013.01); *H04R 5/00* (2013.01); *H04S 2400/11* (2013.01); *H04S 2400/15* (2013.01)

(58) Field of Classification Search
CPC ..... H04S 1/002; H04S 2400/11; H04S 5/00; H04S 2400/15; H04R 5/00
USPC ... 381/17, 1, 18, 98, 310, 61, 307, 303, 306
See application file for complete search history.

(56) References Cited

U.S. PATENT DOCUMENTS

| | | | |
|---|---|---|---|
| 6,265,791 | B1 | 7/2001 | Eberl et al. |
| 6,504,934 | B1 | 1/2003 | Kasai et al. |
| 2003/0053680 | A1 | 3/2003 | Lin et al. |
| 2004/0141622 | A1 | 7/2004 | Squibbs |
| 2006/0247918 | A1 | 11/2006 | Schmidt et al. |

(Continued)

FOREIGN PATENT DOCUMENTS

| | | | |
|---|---|---|---|
| CA | 2717674 | A1 | 9/2009 |
| CN | 1714600 | A | 12/2005 |

(Continued)

OTHER PUBLICATIONS

Communication issued Nov. 13, 2015, issued by the European Patent Office in counterpart European Patent Application No. 11777571.8.

(Continued)

*Primary Examiner* — Paul S Kim
(74) *Attorney, Agent, or Firm* — Sughrue Mion, PLLC

(57) ABSTRACT

Method and apparatus reproduce a stereophonic sound. The method includes obtaining sound depth information which denotes a distance between at least one object within a sound signal and a reference position, and providing sound perspective to the sound object output from a speaker, based on the sound depth information.

25 Claims, 5 Drawing Sheets

(56) References Cited

U.S. PATENT DOCUMENTS

| | | | | |
|---|---|---|---|---|
| 2009/0129609 | A1 | 5/2009 | Oh et al. | |
| 2010/0272417 | A1 | 10/2010 | Nagasawa et al. | |
| 2011/0007915 | A1* | 1/2011 | Park | H04N 5/607 381/306 |
| 2011/0150227 | A1 | 6/2011 | Kim | |
| 2014/0010372 | A1 | 1/2014 | Seo et al. | |

FOREIGN PATENT DOCUMENTS

| | | | |
|---|---|---|---|
| EP | 0932925 | A1 | 8/1999 |
| EP | 1881740 | A2 | 1/2008 |
| EP | 2247116 | A3 | 11/2013 |
| JP | 6269096 | A | 9/1994 |
| JP | 11220800 | A | 8/1999 |
| JP | 2006128816 | A | 5/2006 |
| JP | 2010258872 | A | 11/2010 |
| KR | 1019990068477 | A | 9/1999 |
| KR | 1020050115801 | A | 12/2005 |
| KR | 10-2006-0088295 | A | 8/2006 |
| KR | 100688198 | B1 | 2/2007 |
| KR | 10-2009-0031057 | A | 3/2009 |
| KR | 10-2009-0100566 | A | 9/2009 |
| KR | 100922585 | B1 | 10/2009 |
| KR | 100934928 | B1 | 12/2009 |
| KR | 10-2011-0072923 | A | 6/2011 |
| RU | 2145778 | C1 | 2/2000 |
| RU | 23032 | U1 | 5/2002 |
| RU | 2251818 | C2 | 4/2004 |
| RU | 2232481 | C1 | 7/2004 |
| WO | 0180564 | A1 | 10/2001 |
| WO | 2009/116800 | A9 | 9/2009 |

OTHER PUBLICATIONS

Communication dated Jan. 14, 2015, issued by the Ministry of Justice and Human Rights of the Republic of Indonesia Directorate General of Intellectual Property Rights in counterpart Indonesian Application No. W-00201205040.

Communication dated Jun. 26, 2015 issued by the Canadian Intellectual Property Office in counterpart Canadian Patent Application No. 2,798,558.

Communication dated Mar. 17, 2015, issued by the Japanese Intellectual Property Office in counterpart Japanese Application No. 2013-508997.

Communication dated Nov. 17, 2011 issued by the International Searching Authority in counterpart International Patent Application No. PCT/KR2011/003337.

Communication, dated Aug. 21, 2014, issued by the Federal Service on Industrial Property in counterpart Patent Application No. 2012151848.

Communication, dated Aug. 27, 2014, issued by The State Intellectual Property Office of P.R. China in counterpart Patent Application No. 201180033247.8.

Communication, dated Feb. 24, 2014, issued by the Federal Service for Intellectual Property, Patent and Trademarks in counterpart Russian Patent Application No. 2012151848.

Communication, dated Jul. 8, 2014, issued by the Australian Government in counterpart Patent Application No. 2011249150.

Office Action, dated Oct. 2, 2013, issued by IP Australia, in counterpart Application No. 2011249150.

Communication dated Nov. 21, 2016 issued by Korean Intellectual Property Office in counterpart Korean Application No. 10-2011-0022451.

* cited by examiner

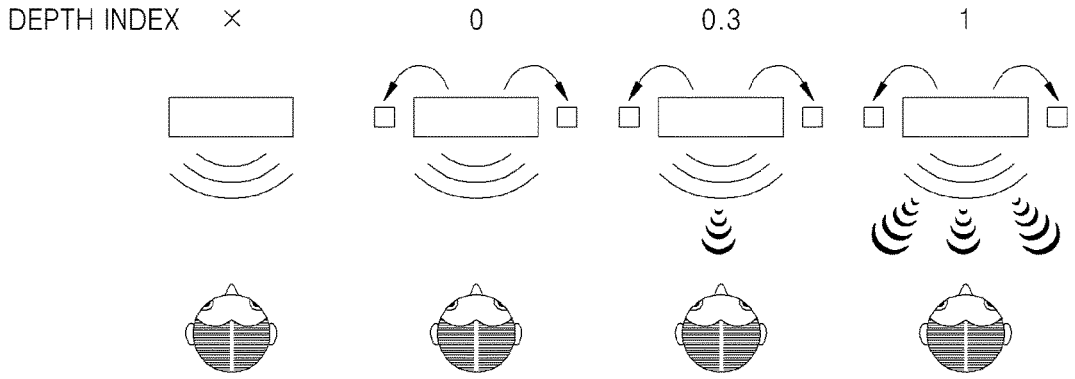
FIG. 4A FIG. 4B FIG. 4C FIG. 4D
FIG. 5
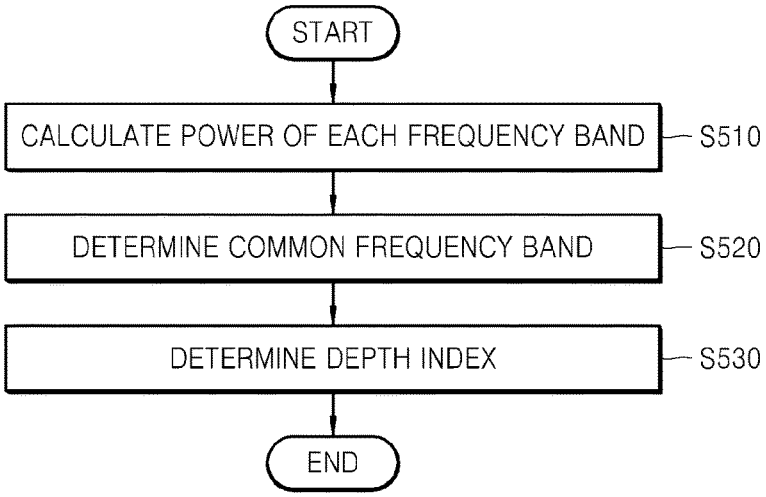

METHOD AND APPARATUS FOR REPRODUCING STEREOPHONIC SOUND

CROSS-REFERENCE TO RELATED PATENT APPLICATIONS

This application is a Continuation of U.S. application Ser. No. 13/100,442, filed May 4, 2011, which claims priority from the Korean Patent Application No. 10-2011-0022451, filed Mar. 14, 2011, in the Korean Intellectual Property Office, and claims the benefit of U.S. Provisional Patent Application No. 61/330,986, filed May 4, 2010. The disclosures of these applications are incorporated herein in their entireties by reference.

BACKGROUND

1. Field

Apparatuses and methods consistent with exemplary embodiments relate to reproducing a stereophonic sound, and more particularly, to reproducing a stereophonic sound, in which perspective is given to a sound object.

2. Description of the Related Art

With the development of video technology, users can now view three-dimensional (3D) stereoscopic images. By using various methods such as, for example, a binocular parallax method, a 3D stereoscopic image exposes left-viewpoint image data to a left eye, and right-viewpoint image data to a right eye. The user may thus realize an object that advances out of a screen or an object returning into the screen realistically using 3D video technology.

On the other hand, stereophonic sound technology may enable the user to sense localization and presence of sounds by disposing a plurality of speakers around the user. However, with the related art stereophonic sound technology, a sound associated with an image object approaching the user or moving away from the user cannot be effectively expressed, and thus, sound effects that correspond to a stereoscopic image cannot be provided.

SUMMARY

Exemplary embodiments may address at least the above problems and/or disadvantages and other disadvantages not described above. Also, exemplary embodiments are not required to overcome the disadvantages described above, and an exemplary embodiment may not overcome any of the problems described above.

One or more exemplary embodiments provide methods and apparatuses for effectively reproducing a stereophonic sound, and more particularly, methods and apparatuses for effectively expressing sounds that approach the user or move away from the user by giving perspective to a sound object.

According to an aspect of an exemplary embodiment, there is provided a method of reproducing a stereophonic sound, the method including: obtaining sound depth information denoting a distance between at least one sound object within a sound signal and a reference position; and giving sound perspective to the sound object based on the sound depth information.

The sound signal may be divided into a plurality of sections, and the obtaining sound depth information includes obtaining the sound depth information by comparing the sound signal in a previous section and the sound signal in a current section.

The obtaining sound depth information may include: calculating a power of each frequency band of each of previous and current sections; determining a frequency band that has a power of a predetermined value or greater and is common to adjacent sections, as a common frequency band based on the power of each frequency band power; and obtaining the sound depth information based on a difference between a power of the common frequency band in the current section and a power of the common frequency band in the previous section.

The method may further include obtaining a center channel signal that is output from the sound signal to a center speaker, and wherein the calculating a power includes calculating a power of each frequency band power based on the center channel signal.

The giving sound perspective may include adjusting the power of the sound object based on the sound depth information.

The giving sound perspective may include adjusting a gain and a delay time of a reflection signal that is generated as the sound object is reflected, based on the sound depth information.

The giving sound perspective may include adjusting a size of a low band component of the sound object based on the sound depth information.

The giving sound perspective may include adjusting a phase difference between a phase of a sound object to be output from a first speaker and a phase of a sound object that is to be output from a second speaker.

The method may further include outputting the sound object, to which the perspective is given, using a left-side surround speaker and a right-side surround speaker or using a left-side front speaker and a right-side front speaker.

The method may further include locating a sound stage at an outside of a speaker by using the sound signal.

According to another aspect of an exemplary embodiment, there is provided a stereophonic sound reproducing apparatus including: an information obtaining unit obtaining sound depth information denoting a distance between at least one sound object within a sound signal and a reference position; and a perspective providing unit giving sound perspective to the sound object based on the sound depth information.

BRIEF DESCRIPTION OF THE DRAWINGS

The above and/or other aspects will become more apparent by describing certain exemplary embodiments, with reference to the accompanying drawings, in which:

FIGS. 4A, 4B, 4C and 4D illustrate examples of providing a stereophonic sound according to an exemplary embodiment;

FIG. 5 illustrates a flowchart illustrating a method of generating sound depth information based on a sound signal, according to an exemplary embodiment;

DETAILED DESCRIPTION OF EXEMPLARY EMBODIMENTS

Figure 1:
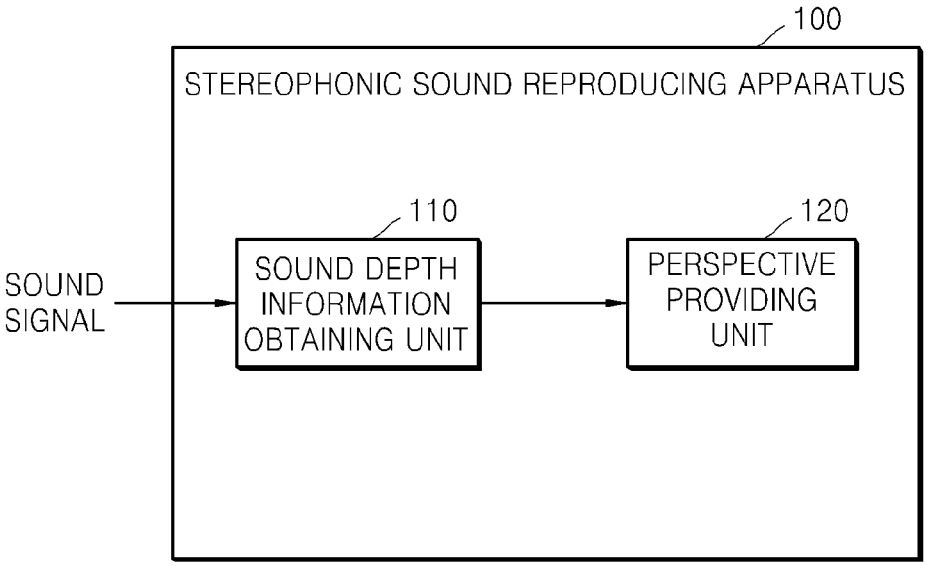
FIG. 1 is a block diagram illustrating a stereophonic sound reproducing apparatus according to an exemplary embodiment.

Certain exemplary embodiments are described in greater detail below with reference to the accompanying drawings.

In the following description, like drawing reference numerals are used for the like elements, even in different drawings. The matters defined in the description, such as detailed construction and elements, are provided to assist in a comprehensive understanding of exemplary embodiments. However, exemplary embodiments can be practiced without those specifically defined matters.

First, terms used in exemplary embodiments are described for convenience of description.

A sound object refers to each sound element included in a sound signal. In a sound signal, various sound objects may be included. For example, in a sound signal generated by recording the actual scene of a performance by an orchestra, various sound objects generated from various musical instruments such as a guitar, a violin, an oboe, etc. are included.

A sound source refers to an object that has generated a sound object such as a musical instrument or a voice. In an exemplary embodiment, an object that has generated a sound object and an object that is considered by the user to have generated a sound object are referred to as a sound source. For example, if an apple is flying from a screen to the user while the user is watching a movie, a sound generated by the flying apple (sound object) is included in a sound signal. The sound object may be a sound that is generated by recording the actual sound generated when the apple is being thrown or may be a replayed sound of a previously recorded sound object. However, in either way, the user perceives the apple to have generated the sound object, and thus, the apple is also regarded as the sound source defined in an exemplary embodiment.

Sound depth information is information that denotes a distance between a sound object and a reference position. In detail, the sound depth information refers to a distance between a position where a sound object is generated (the position of a sound source) and a reference position.

In the above-described example, if an apple is flying from the screen to the user while the user is watching a movie, the distance between the sound source and the user reduces. In order to effectively express the approaching apple, the position where the sound object corresponding to an image object is generated needs to be expressed as gradually approaching the user, and information to express this aspect is the sound depth information.

A reference position may include various positions such as, for example, a position of a predetermined sound source, a position of a speaker, a position of the user, etc.

Sound perspective is a type of sensation that the user experiences through a sound object. By hearing a sound object, the user perceives the position where the sound object is generated, that is, the position of the sound source that has generated the sound object. A sense of distance between the position where the sound object is generated and the position of user is referred to as sound perspective.

Hereinafter, exemplary embodiments are described with reference to the accompanying drawings.

FIG. 1 is a block diagram illustrating a stereophonic sound reproducing apparatus 100 according to an exemplary embodiment.

The stereophonic sound reproducing apparatus 100 includes a sound depth information obtaining unit 110 and a perspective providing unit 120.

The sound depth information obtaining unit 110 obtains the sound depth information with respect to at least one sound object included in a sound signal. A sound generated in at least one sound source is included in a sound signal. Sound depth information refers to information that represents a distance between a position where the sound is generated, for example, a position of a sound source, and a reference position.

Sound depth information may refer to an absolute distance between an object and a reference position, and/or to a relative distance of an object with respect to a reference position. According to another exemplary embodiment, the sound depth information may refer to a variation in a distance between a sound object and a reference position.

The sound depth information obtaining unit 110 may obtain the sound depth information by analyzing a sound signal, by analyzing 3D image data, or from an image depth map. In an exemplary embodiment, the description is provided based on an example in which the sound depth information obtaining unit 110 obtains the sound depth information by analyzing a sound signal.

The sound depth information obtaining unit 110 obtains the sound depth information by comparing a plurality of sections that constitute a sound signal with adjacent sections thereto. Various methods of dividing a sound signal into sections may be used. For example, a sound signal may be divided for predetermined number of samples. Each divided section may be referred to as a frame or a block. An example of the sound depth information obtaining unit 110 is described in detail below with reference to FIG. 2.

The perspective providing unit 120 processes a sound signal based on the sound depth information so that the user may sense sound perspective. The perspective providing unit 120 performs the operations described below in order to enable the user to sense the sound perspective effectively. However, the operations performed by the perspective providing unit 120 are examples, and exemplary embodiments are not limited thereto.

The perspective providing unit 120 adjusts power of a sound object based on the sound depth information. The closer to the user a sound object is generated, the greater the power of the sound object.

The perspective providing unit 120 adjusts a gain and a delay time of a reflection signal based on the sound depth information. The user hears a direct sound signal that is generated by an object without being reflected by an obstacle and a reflection sound signal generated by an object by being reflected by an obstacle. The reflection sound signal has a smaller amplitude than the direct sound signal, and is delayed, as compared to the direct sound signal, by a predetermined period of time when it arrives at a position of the user. In particular, if a sound object is generated near the user, a reflection sound signal arrives substantially later as compared to the direct sound signal, and thus has a substantially smaller amplitude than that of the direct sound signal.

The perspective providing unit 120 adjusts a low band component of a sound object based on the sound depth information. If a sound object is generated near the user, the user perceives a low band component to be large.

The perspective providing unit 120 adjusts a phase of a sound object based on the sound depth information. The greater a difference between a phase of a sound object that is to be output from a first speaker and a phase that is to be output from a second speaker, the user perceives the sound object to be closer.

Detailed description of the operations of the perspective providing unit 120 is provided below with reference to FIG. 3.

Figure 2:
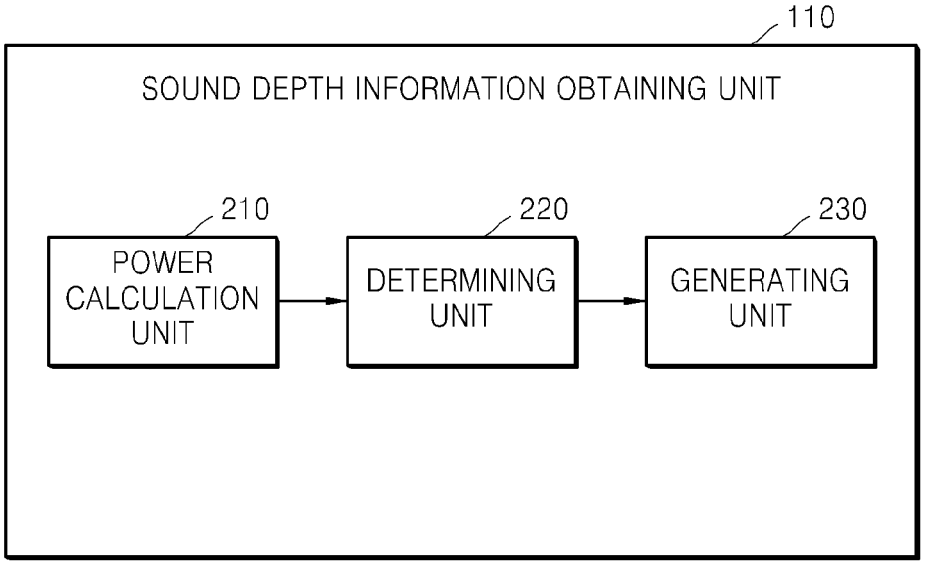
FIG. 2 is a block diagram illustrating a sound depth information obtaining unit according to an exemplary embodiment.

FIG. 2 is a block diagram illustrating the sound depth information obtaining unit 110 according to an exemplary embodiment.

The sound depth information obtaining unit 110 includes a power calculation unit 210, a determining unit 220, and a generating unit 230.

The power calculation unit 210 calculates a power of a frequency band of each of a plurality of sections that constitute a sound signal.

A method of determining a size of a frequency band may vary according to exemplary embodiments. Hereinafter, two methods of determining a size of a frequency band are described, but an exemplary embodiment is not limited thereto.

A frequency component of a sound signal may be divided into identical frequency bands. An audible frequency range that humans can hear is 20-20000 Hz. If the audible frequency is divided into ten identical frequency bands, a size of each frequency band is about 200 Hz. The method of dividing a frequency band of a sound signal into identical frequency bands may be referred to as an equivalent rectangular bandwidth division method.

A frequency component of a sound signal may be divided into frequency bands of different sizes. Humans' hearing can recognize even a small frequency change when hearing a low frequency sound, but when hearing a high frequency sound, humans cannot recognize even a small frequency change. Accordingly, low frequency bands are divided densely, and high frequency bands are divided coarsely, considering humans' sense of hearing. Thus, the low frequency bands have narrow widths, and the high frequency bands have wider widths.

Based on the power of each frequency band, the determining unit 220 determines a frequency band that has a power of a predetermined value or greater and is common to adjacent sections, as a common frequency band. For example, the determining unit 220 selects frequency bands having a power of A or greater in a current section, and frequency bands having a power of A or greater in at least one previous section (or frequency bands having the fifth greatest power in the current section or frequency bands having the fifth greatest power in the previous section), and determines a frequency band that is selected from the previous section and the current section as a common frequency band. The reason why it is limited to frequency bands of a predetermined value or greater is to obtain a position of a sound object having a great signal amplitude. Thus, an influence of a sound object having a small signal amplitude may be minimized, and an influence of a main sound object may be maximized. Another reason why the determining unit 220 determines the common frequency band is to determine whether a new sound object, which did not exist in the previous section, is generated in the current section or whether characteristics of a sound object that previously existed (e.g., a generation position) has changed.

The generating unit 230 generates the sound depth information based on a difference between a power of the common frequency band of the previous section and power of the common frequency band of the current section. For convenience of description, a common frequency band is assumed to be 3000-4000 Hz. If a power of a frequency component of 3000-4000 Hz in the previous section is 3 W, and a power of a frequency component of 3000-4000 Hz in the current section is 4.5 W, it indicates that a power of the common frequency band has increased. This may be regarded as an indication that a sound object of the current section is generated at a closer position to the user. That is, if a difference value of the power values of the common frequency between the adjacent sections is greater than a threshold, this may be an indication of a position change between the sound object and the reference position.

According to exemplary embodiments, when the power of the common frequency band of adjacent sections varies, it is determined whether there is an image object that approaches the user, that is, an image object that advances from a screen, based on the depth map information with respect to a 3D image. If an image object is approaching the user when the power of the common frequency band varies, it may be determined that the position where the sound object is generated is moving in accordance with movement of the image object.

The generating unit 230 may determine that the greater the variation of power of the common frequency band between the previous section and the current section, the closer to the user a sound object corresponding to the common frequency band is generated in the current section as compared to a sound object corresponding to the common frequency band in the previous section.

Figure 3:
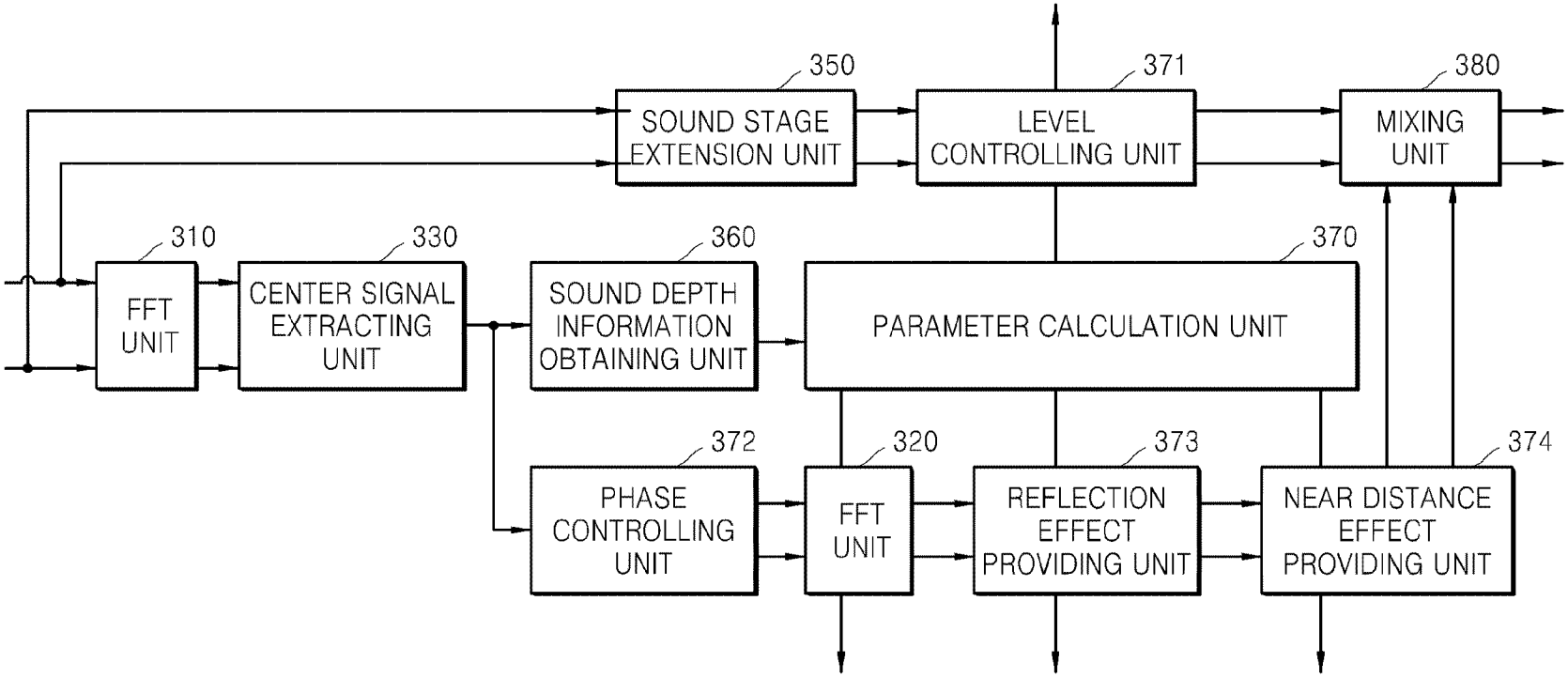
FIG. 3 is a block diagram illustrating a stereophonic sound reproducing apparatus providing a stereophonic sound by using a two-channel sound signal, according to an exemplary embodiment.

FIG. 3 is a block diagram illustrating a stereophonic sound reproducing apparatus 300 providing a stereophonic sound by using a two-channel sound signal, according to an exemplary embodiment.

If an input signal is a multi-channel sound signal, down-mixing is performed using a stereo signal, and then the method of an exemplary embodiment may be applied.

A fast Fourier transform (FFT) unit 310 performs an FFT.

An inverse fast Fourier transform (IFFT) unit 320 performs an IFFT with respect to the signal to which the FFT is performed.

A center signal extracting unit 330 extracts a center signal corresponding to a center channel, from the stereo signal. The center signal extracting unit 330 extracts a signal having a large correlation, from the stereo signal. In FIG. 3, it is assumed that the sound depth information is generated based on a center channel signal. However, this is an example, and the sound depth information may be generated using other channel signals such as, for example, left or right front channel signals or left or right surround channel signals.

A sound stage extension unit 350 extends a sound stage. The sound stage extension unit 350 artificially provides a time difference or a phase difference to a stereo signal so that a sound stage is located at an outer side of a speaker.

The sound depth information obtaining unit 360 obtains the sound depth information based on a center signal.

A parameter calculation unit 370 determines a control parameter value that is needed to provide sound perspective to a sound object based on the sound depth information.

A level controlling unit 371 controls amplitude of an input signal.

A phase controlling unit 372 adjusts a phase of an input signal.

A reflection effect providing unit 373 models a reflection signal that is generated by an input signal reflected by, for example, a wall.

A near distance effect providing unit 374 models a sound signal that is generated at a near distance from the user.

A mixing unit 380 mixes at least one signal and outputs the same to a speaker.

Hereinafter, an operation of the stereophonic sound reproducing apparatus 300 in a time order is described.

First, when a multi-channel sound signal is input, the multi-channel sound signal is converted to a stereo signal using a down-mixer (not shown).

The FFT unit 310 performs FFT with respect to a stereo signal and outputs the stereo signal to the center signal extracting unit 330.

The center signal extracting unit 330 compares the transformed stereo signals and outputs a signal having largest correlation as a center channel signal.

The sound depth information obtaining unit 360 generates the sound depth information based on the center channel signal. A method of generating the sound depth information by using the sound depth information obtaining unit 360 is as described above with reference to FIG. 2. That is, first, a power of each frequency band of each of the sections constituting the center channel signal is calculated, and a common frequency band is determined based on the calculated power. Then, a power variation of the common frequency band in at least two adjacent sections is measured, and a depth index is set according to the power variation. The greater the power variation of the common frequency band of the adjacent sections, the more a sound object corresponding to the common frequency band needs to be expressed as approaching the user, and thus a large depth index value of a sound object is set.

The parameter calculation unit 370 calculates a parameter that is to be applied to modules for giving sound perspective based on the depth index value.

The phase controlling unit 371 adjusts a phase of a signal that is duplicated according to the calculated parameter after duplicating the center channel signal into two signals. When the sound signals of different phases are reproduced using a left-side speaker and a right-side speaker, blurring may occur. The more intense the blurring is, the more difficult it is for the user to accurately perceive the position where the sound object is generated. Due to this phenomenon, when a phase controlling method is used together with other perspective giving methods, the effect of providing perspective may be increased. The closer the position where the sound object is generated is to the user (or the faster the generation position approaches the user), the phase controlling unit 372 may set a larger phase difference between phases of the duplicated signals. A duplication signal having an adjusted phase passes by the IFFT unit 320 to be transmitted to the reflection effect providing unit 373.

The reflection effect providing unit 373 models a reflection signal. If a sound object is generated away from the user, a direct sound that is directly transmitted to the user without being reflected by, for example, a wall, and a reflection sound that is generated by being reflected by, for example, a wall, have similar amplitudes, and there is hardly a time difference between the direct sound and the reflection sound which arrive at the user. However, if a sound object is generated near the user, an amplitude difference between the direct sound and the reflection sound is great, and a difference in time points that the direct sound and the reflection sound which arrive at the user is great. Accordingly, the closer to the user the sound object is generated, to the greater degree the reflection effect providing unit 373 reduces a gain value of a reflection signal and further increases a time delay or increases the amplitude of the direct sound. The reflection effect providing unit 373 transmits a center channel signal with which a reflection signal is considered to the near distance effect providing unit 374.

The near distance effect providing unit 374 models a sound object generated at a close distance to the user based on a parameter value calculated by using the parameter calculation unit 370. If a sound object is generated at a close position to the user, a low band component becomes prominent. The closer the position where the sound object is generated is to the user, the more the near distance effect providing unit 374 increases a low band component of the center signal.

The sound stage extension unit 350 that has received a stereo input signal processes the stereo input signal so that a sound stage of the stereo input signal is located at an outer side of speakers. If a distance between the speakers is appropriate, the user may hear a stereophonic sound with presence.

The sound stage extension unit 350 transforms the stereo input signal to a widening stereo signal. The sound stage extension unit 350 may include a widening filter which is obtained through convolution of left/right binaural synthesis and a crosstalk canceller and a paranormal filter that is obtained through convolution of a widening filter and a left/right direct filter. The widening filter forms a virtual sound with respect to an arbitrary position based on a head related transfer function (HRTF) measured at a predetermined position of a stereo signal, and cancels crosstalk of the virtual sound source based on a filter coefficient to which the HRTF is reflected. The left and right direct filters adjust signal characteristics such as, for example, a gain or delay between the original stereo signal and the virtual sound source having cancelled crosstalk.

The level controlling unit 360 adjusts a power value of the sound object based on a depth index calculated by using the parameter calculation unit 370. The level controlling unit 360 may further increase the power value of the sound object when the sound object is generated closer to the user.

The mixing unit 380 combines the stereo input signal transmitted by the level controlling unit 360 and the center signal transmitted by the near distance effect providing unit 374.

FIGS. 4A through 4D illustrate examples of providing a stereophonic sound according to an exemplary embodiment.

FIG. 4A illustrates a case in which a stereophonic sound object according to an exemplary embodiment does not operate.

A user hears a sound object using at least one speaker. If the user reproduces a mono signal using a single speaker, the user cannot sense a stereo effect, but when a stereo signal is reproduced using two or more speakers, the user may sense a stereo effect.

FIG. 4B illustrates a case in which a sound object whose depth index is 0 is reproduced. Referring to FIGS. 4A through 4D, it is assumed that the depth index has a value from 0 to 1. The closer to the user a sound object is to be expressed to be generated, the greater a value of the depth index becomes.

Since the depth index of the sound object is 0, an operation of giving perspective to the sound object is not performed. However, by allowing a sound stage to be located at an outer side of the speakers, the user is enabled to sense a stereo effect better using a stereo signal. According to an exemplary embodiment, a technique of locating a sound stage at an outer side of the speakers is referred to as widening.

Generally, sound signals of a plurality of channels are needed to reproduce a stereo signal. Thus, when a mono signal is input, sound signals corresponding to at least two channels are generated by upmixing.

A stereo signal is reproduced by reproducing a sound signal of a first channel through a left-side speaker, and a sound signal of a second channel through a right-side speaker. The user may sense a stereo effect by hearing at least two sounds generated at different positions.

However, if the left-side speaker and the right-side speaker are disposed too close to each other, the user perceives sounds to be generated at the same position and thus may not sense a stereo effect. In this case, the sound signals are processed so that the sounds are perceived as being generated not from the actual position of the speakers but from an outer side of the speakers; that is, from an area external to the speakers, such as, for example, the area surrounding the speakers or adjacent to the speakers.

FIG. 4C illustrates a case in which a sound object having a depth index of 0.3 is reproduced, according to an exemplary embodiment.

Since the depth index of the sound object is greater than 0, in addition to the widening technique, perspective corresponding to the depth index of 0.3 is given to the sound object. Accordingly, the user may sense the sound object to be generated at a position closer to the user than where it is actually generated.

For example, it is assumed that the user is watching 3D image data, and an image object is expressed as being popped out of a screen. In FIG. 4C, the sound perspective is given to a sound object corresponding to an image object so as to process the sound object as if it is approaching the user. The user perceives the image data as protruding and the sound object as approaching, thereby sensing a more realistic stereo effect.

FIG. 4D illustrates a case in which a sound object having a depth index of 1 is reproduced.

Since a depth index of the sound object is greater than 0, in addition to the widening technique, the sound perspective corresponding to the depth index of 1 is given to the sound object. Because the depth index of the sound object illustrated in FIG. 4D is greater than that of the sound object of FIG. 4C, the user may sense the sound object to be generated at a closer position than that of FIG. 4C.

FIG. 5 illustrates a flowchart illustrating a method of generating the sound depth information based on a sound signal, according to an exemplary embodiment.

In operation S510, a power of a frequency band of each of the sections constituting a sound signal is calculated.

In operation S520, a common frequency band is determined based on the power of each frequency band.

A common frequency band refers to a frequency band that has a power of a predetermined value or greater and is common to the previous section and the current section. Here, a frequency band having a small power may be a meaningless sound object such as, for example, noise, and thus, may be excluded from the common frequency band. For example, a predetermined number of frequency bands may be selected in a descending order of the power values, and then a common frequency band may be determined among the selected frequency bands.

In operation S530, the power of the common frequency band of the previous section and the power of the common frequency band of the current section are compared, and a depth index value is determined based on a comparison result. If the power of the common frequency band of the current section is greater than the power of the common frequency band of the previous section, it is determined that a sound object corresponding to the common frequency band is to be generated at a closer position to the user. If the power of the common frequency band of the current section and the power of the common frequency band of the previous section are similar, it is determined that the sound object is not approaching the user.

FIGS. 6A through 6D illustrate an example of generating the sound depth information from a sound signal according to an exemplary embodiment.

Figures 6A, 6B, 6C, 6D:
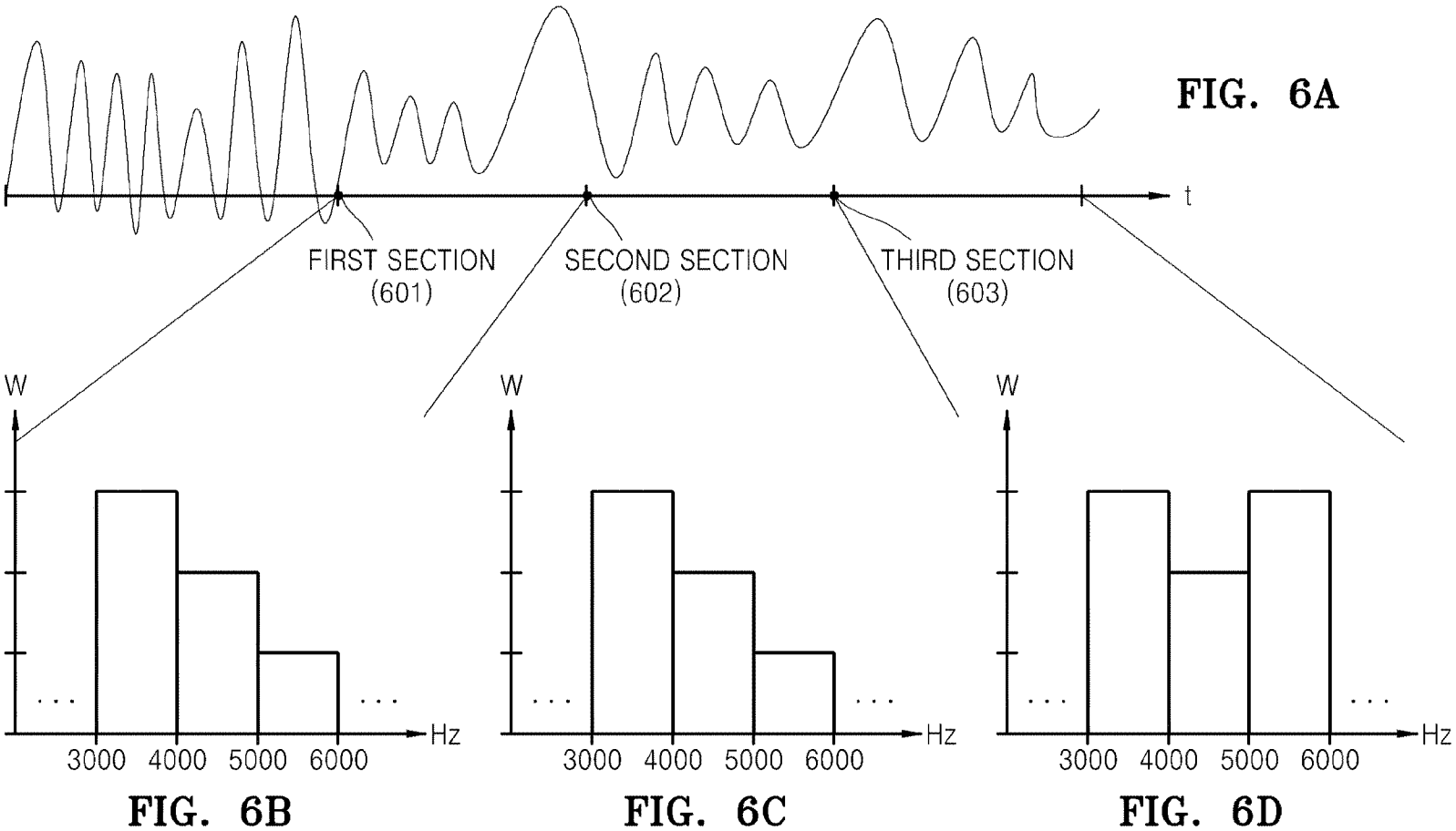
FIGS. 6A, 6B, 6C, and 6D illustrate an example of generating sound depth information from a sound signal according to an exemplary embodiment.

FIG. 6A illustrates a sound signal divided into a plurality of sections along a time axis, according to an exemplary embodiment.

FIGS. 6B through 6D illustrate power of frequency bands in first, second, and third sections 601, 602, and 603. In FIGS. 6B through 6D, the first section 601 and the second section 602 are the previous sections, and the third section 603 is a current section.

Referring to FIGS. 6B and 6C, in the first section 601 and the second section 602, powers of frequency bands of 3000-4000 Hz, 4000-5000 Hz, and 5000-6000 Hz are similar. Accordingly, the frequency bands of 3000-4000 Hz, 4000-5000 Hz, and 5000-6000 Hz are determined as a common frequency band.

Referring to FIGS. 6C and 6D, when assuming that powers of the frequency bands of 3000-4000 Hz, 4000-5000 Hz, and 5000-6000 Hz are a predetermined value or greater in all of the first section 601, the second section 602, and the third section 603, the frequency bands of 3000-4000 Hz, 4000-5000 Hz, and 5000-6000 Hz are determined as a common frequency band.

However, in the third section 603, the power of the frequency band of 5000-6000 Hz is substantially increased as compared to the power of the frequency band of 5000-6000 Hz in the second section 602. Thus, a depth index of a sound object corresponding to the frequency band of 5000-6000 Hz is decided to be 0 or greater. According to an exemplary embodiment, an image depth map may be referred to in order to decide the depth index of the sound object.

For example, the power of the frequency band of 5000-6000 Hz is substantially increased in the third section 603 as compared to that in the second section 602. According to circumstances, this may be the case where the position where a sound object corresponding to the frequency band of 5000-6000 Hz is generated has not approached the user but only a value of power is increased at the same position. Here, if there is an image object that advances from a screen in an image frame corresponding to the third section 603 when referring to an image depth map, the possibility that the sound object corresponding to the frequency band of 5000-6000 Hz corresponds to an image object may be high. In this case, the position where the sound object is generated gradually approaches the user, and thus, a depth index of the sound object is set to be 0 or greater. On the other hand, if there is no image object protruding out of a screen in an image frame corresponding to the third section 603, it may be regarded as that only the power of the sound object has increased while the same position is maintained, and thus, the depth index of the sound object may be set to 0.

Figure 7:
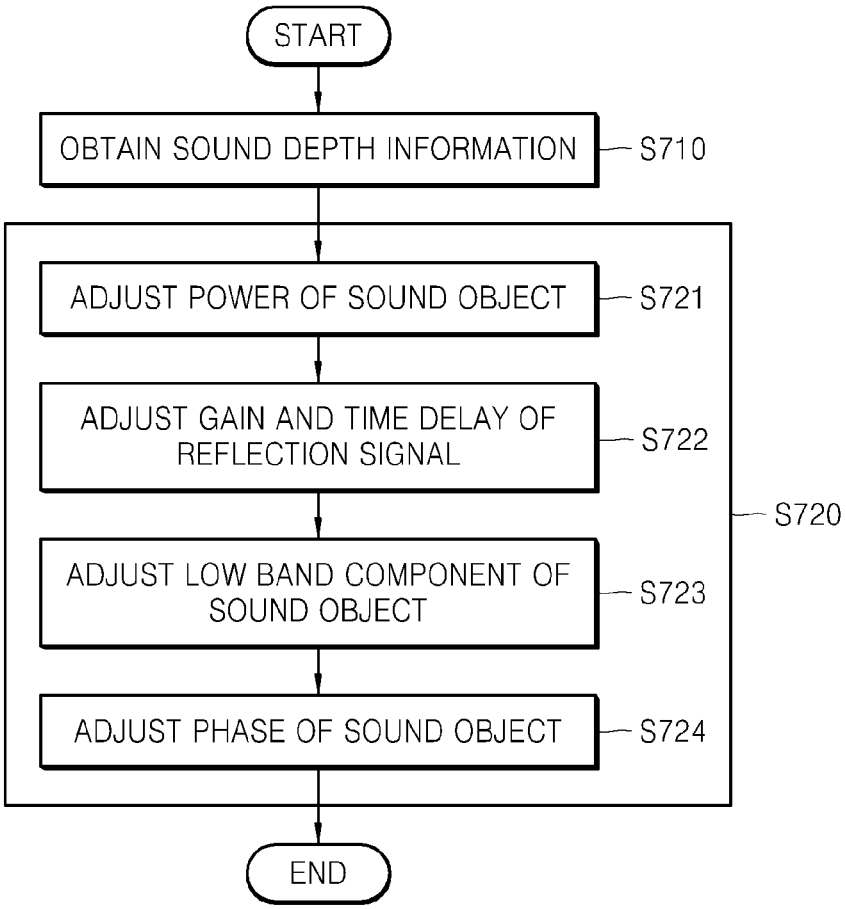
FIG. 7 illustrates a flowchart illustrating a method of reproducing a stereophonic sound according to an exemplary embodiment.

FIG. 7 is a flowchart illustrating a method of reproducing a stereophonic sound according to an exemplary embodiment.

In operation S710, the sound depth information is obtained. The sound depth information refers to information representing a distance between at least one sound object within a sound signal and a reference position.

In operation S720, the sound perspective is given to a sound object based on the sound depth information. Operation S720 may include at least one of operations S721 and S722.

In operation S721, a power gain of the sound object is adjusted based on the sound depth information.

In operation S722, a gain and a delay time of a reflection signal generated as a sound object is reflected by an obstacle are adjusted based on the sound depth information.

In operation S723, a low band component of the sound object is adjusted based on the sound depth information.

In operation S724, a phase difference between a phase of a sound object to be output from a first speaker and a phase of a sound object that is to be output from a second speaker is adjusted.

According to the related art, it is difficult to obtain depth information because depth information of an image object is to be provided as additional information or because the depth information of an image object needs to be obtained by analyzing image data. However, according to an exemplary embodiment, based on the fact that information about a position of the image object can be included in a sound signal, depth information is generated by analyzing a sound signal. Thus, depth information of an image object may be easily obtained.

Also, according to the related art, phenomena such as an image object advancing from a screen or returning into the screen is not appropriately expressed using a sound signal. However, according to an exemplary embodiment, by expressing sound objects that are generated as an image object protrudes or returns to a screen, the user may sense a more realistic stereo effect.

In addition, according to an exemplary embodiment, a distance between the position where the sound object is generated and a reference position can be effectively expressed. In particular, since perspective is given to each sound object, the user may effectively sense a sound stereo effect.

Exemplary embodiments can be embodied as computer programs and can be implemented in general-use digital computers that execute the programs using a computer-readable recording medium.

Examples of the computer-readable recording medium include storage media such as, for example, magnetic storage media (e.g., ROM, floppy disks, hard disks, etc.) and optical recording media (e.g., CD-ROMs, or DVDs).

The foregoing exemplary embodiments and advantages are merely exemplary and are not to be construed as limiting. The present teaching can be readily applied to other types of apparatuses. Also, the description of the exemplary embodiments is intended to be illustrative, and not to limit the scope of the claims, and many alternatives, modifications, and variations will be apparent to those skilled in the art.

What is claimed is:

1. A method of reproducing a stereophonic sound, the method comprising:

dividing the sound signal into a sequence of adjacent sections, based on time;

obtaining sound depth information corresponding to a distance between a sound object within a sound signal and a position of a user by comparing intensity values of the sound signal in corresponding adjacent sections; and providing sound perspective to the sound object output from a speaker, based on the sound depth information.

2. The method of claim 1, wherein the obtaining the sound depth information comprises obtaining the sound depth information by comparing the sound signal in a previous section and the sound signal in a current section, of the adjacent sections.

3. The method of claim 2, wherein the obtaining the sound depth information comprises:

calculating a power of each frequency band of the previous and current sections;

determining a frequency band that has a power of a predetermined value or greater and is common to the adjacent sections, as a common frequency band based on the calculated power of each frequency band; and obtaining the sound depth information based on a difference between a power of the common frequency band in the current section and a power of the common frequency band in the previous section.

4. The method of claim 3, further comprising:

obtaining a center channel signal that is output from the sound signal to a center speaker, and wherein the calculating the power comprises calculating the power of each frequency band based on the center channel signal.

5. The method of claim 1, wherein the providing the sound perspective comprises:

adjusting the power of the sound object based on the sound depth information.

6. The method of claim 1, wherein the providing the sound perspective comprises:

adjusting a gain and a delay time of a reflection signal that is generated as the sound object is reflected, based on the sound depth information.

7. The method of claim 6, wherein the adjusting the gain and the delay time comprises:

when the sound object is generated closer to the user, reducing the gain value of the reflection signal and increasing the time delay.

8. The method of claim 1, wherein the providing the sound perspective comprises:

adjusting a size of a low band component of the sound object based on the sound depth information.

9. The method of claim 8, wherein the adjusting the size of the low band component comprises:

when the sound object is generated at a close position to the user, increasing the size of the low band component.

10. The method of claim 1, wherein the providing the sound perspective comprises:

adjusting a phase difference between a phase of a sound object to be output from a first speaker and a phase of a sound object that is to be output from a second speaker.

11. The method of claim 10, wherein the adjusting the phase difference comprises:

when the position where the sound object is generated closer to the user, setting the phase difference between phases to be larger.

12. The method of claim 1, further comprising:

outputting the sound object, to which the perspective is provided, using a left-side surround speaker and a right-side surround speaker or using a left-side front speaker and a right-side front speaker.

13. The method of claim 1, further comprising:

locating a sound stage at an external area of a speaker by using the sound signal.

14. A stereophonic sound reproducing apparatus comprising:

a processor which obtains sound depth information corresponding to a distance between a sound object within a sound signal and a position of a user, and provides sound perspective to an output sound object based on the sound depth information, wherein the sound signal is divided into a sequence of adjacent sections, based on time, and the processor is configured to obtain the sound depth information by comparing intensity values of the sound signal in corresponding adjacent sections.

15. The stereophonic sound reproducing apparatus of claim 14, wherein the processor obtains the sound depth information by comparing the sound signal in a previous section and the sound signal in a current section, of the adjacent sections.

16. The stereophonic sound reproducing apparatus of claim 15, wherein the processor calculates a power of each frequency band of the previous and current sections determines a frequency band that has a power of a predetermined value or greater and is common to the adjacent sections, as a common frequency band based on the calculated power of each frequency band, and generates the sound depth information based on a difference between a power of the common frequency band in the current section and a power of the common frequency band in the previous section.

17. The stereophonic sound reproducing apparatus of claim 16, wherein the processor obtains a center channel signal that is output from the sound signal to a center speaker, and calculation unit calculates the power of each frequency band based on a channel signal corresponding to the center channel signal.

18. The stereophonic sound reproducing apparatus of claim 14, wherein the processor adjusts the power of the sound object based on the sound depth information.

19. The stereophonic sound reproducing apparatus of claim 14, wherein the processor adjusts a gain and a delay time of a reflection signal that is generated as the sound object is reflected, based on the sound depth information.

20. The stereophonic sound reproducing apparatus of claim 14, wherein the processor adjusts a size of a low band component of the sound object based on the sound depth information.

21. The stereophonic sound reproducing apparatus of claim 14, wherein the processor adjusts a phase difference between a phase of a sound object to be output from a first speaker and a phase of a sound object that is to be output from a second speaker.

22. The stereophonic sound reproducing apparatus of claim 14, wherein the processor outputs the sound object, to which the sound perspective is provided, by using a left-side surround speaker and a right-side surround speaker or by using a left-side front speaker and a right-side front speaker.

23. The stereophonic sound reproducing apparatus of claim 14, wherein the apparatus locates a sound stage at an external area of a speaker by using the sound signal.

24. A non-transitory computer-readable recording medium having embodied thereon a program which, when executed by a computer, causes the computer to execute the method of claim 1.

25. A method comprising:

dividing the sound signal into a sequence of adjacent sections, based on time;

providing a sound signal comprising a sound object;

obtaining sound depth information which corresponds a distance between the sound object and a position of a user by comparing intensity values of the sound signal in corresponding adjacent sections;

providing sound perspective for the sound object based on the sound depth information;

reproducing a stereophonic sound signal which exhibits the sound perspective; and outputting the stereophonic sound signal with the provided sound perspective.

* * * * *